US007735664B1

(12) United States Patent
Peters et al.

(10) Patent No.: US 7,735,664 B1
(45) Date of Patent: Jun. 15, 2010

(54) TAPERED THREAD STRUCTURE

(75) Inventors: Mike Lynn Peters, New Castle, PA (US); Richard D Lohrman, North Aurora, IL (US)

(73) Assignee: Portola Packaging, Inc., Batavia, IL (US)

( * ) Notice: Subject to any disclaimer, the term of this patent is extended or adjusted under 35 U.S.C. 154(b) by 215 days.

(21) Appl. No.: 11/379,101

(22) Filed: Apr. 18, 2006

(51) Int. Cl.
*B65B 7/28* (2006.01)
*B65D 39/08* (2006.01)

(52) U.S. Cl. ..... 215/44; 215/252

(58) Field of Classification Search ..... 53/316, 53/315, 313, 287, 490, 331.5, 485, 317, 329; 215/250, 316, 200
See application file for complete search history.

(56) References Cited

U.S. PATENT DOCUMENTS 1,499,612 A * 7/1924 Hammer ..... 215/44
1,582,681 A * 4/1926 Hammer ..... 215/43
2,348,014 A * 5/1944 Mallard ..... 222/481
2,589,005 A * 3/1952 Welhart ..... 215/44
3,484,012 A * 12/1969 White et al. ..... 215/252
4,147,268 A * 4/1979 Patel et al. ..... 215/252
4,164,377 A * 8/1979 Lohrman et al. ..... 401/213
4,280,631 A * 7/1981 Lohrman ..... 215/204
4,412,409 A * 11/1983 Aichinger et al. ..... 53/485
4,496,066 A * 1/1985 Bullock, III ..... 215/320
4,562,930 A * 1/1986 Lecinski et al. ..... 215/44
4,798,303 A * 1/1989 Arnold ..... 215/329
4,846,361 A * 7/1989 Haffner ..... 215/252
5,100,011 A * 3/1992 Maietta ..... 215/256
5,143,235 A * 9/1992 Repp ..... 215/256
5,785,195 A * 7/1998 Zwemer et al. ..... 215/329
6,381,928 B1 * 5/2002 Gregory ..... 53/468
6,484,896 B2 * 11/2002 Ma ..... 215/252
6,942,114 B2 * 9/2005 Nishida ..... 215/252
2004/0108294 A1 * 6/2004 Bloom et al. ..... 215/276
2005/0263476 A1 * 12/2005 Harrison et al. ..... 215/44
2007/0158295 A1 * 7/2007 Lohrman et al. ..... 215/252

FOREIGN PATENT DOCUMENTS

EP 144450 A1 * 6/1985

* cited by examiner

*Primary Examiner*—Anthony Stashick
*Assistant Examiner*—Robert J Hicks
(74) *Attorney, Agent, or Firm*—James P. Hanrath; Adam K. Sacharoff

(57) ABSTRACT

In one embodiment there is provided a novel container neck finish having a substantially cylindrical exterior wall surface surrounding an orifice defined in the container and a thread structure positioned about the exterior wall surface. The thread structure has at least a first portion and a second portion. Each portion has a corresponding effective maximum diameter, wherein the effective maximum diameter of the first portion is less than the effective maximum diameter of the second portion.

14 Claims, 12 Drawing Sheets

FINISH (PRIOR ART FINISH)

TAPERED THREAD STRUCTURE

FIELD OF THE INVENTION

The present invention relates to tapered thread structures on a container finish and a corresponding closure.

BACKGROUND

Thread structures used on containers can take a wide variety of designs. The details of any one particular thread structure on a container is influenced by many factors, including the contained contents, operational aspects of the complimentary closure, materials, methods of package manufacture and consumer use.

A particularly useful and widely accepted closure/seal system for packages is to position external threads on the container which mate with internal threads positioned on the interior wall of a closure. As is well known, the closure is removed and reapplied by rotary threading action.

One factor requiring attention with threaded closure systems is the circumferential extent of mating thread engagement between closure and container. One may desire to minimize circumferential thread engagement to only that required for adequate closure retention for a number of reasons. These include avoiding requirements for excessive turning during closure manipulation by the consumer. Moreover, equipment associated with rotary capping operations is normally restricted in the number of "turns" of the closure allowed during initial application. On the other hand, there must be enough thread engagement for proper threading and sealing on application. A common "rule-of-thumb" in classic packaging technology is that at least a single turn of thread engagement should be incorporated into the designed thread engagement between the fully applied closure and container. This "rule-of-thumb" is most often adequate for packaging using classic materials and fabrication, such as combinations of rigid glass containers and rigid polystyrene or polypropylene closures. In these cases the complimentary threads have been designed to be relatively massive (such as the familiar modified buttress design) with substantial thread depth. In this way the required surface contact between the topside of the closure thread and the underside of the container thread is normally achieved with one turn (360 degrees) of complimentary thread engagement.

It is common to deviate from the "classical" packaging designs, materials, and fabrication for a myriad of reasons, such as, to provide lightweight packaging by thinning the wall sections and structural improvements. However, when providing lightweight packaging other concerns such as part flexibility and distortion are increased. Another example is the choice of alternate materials such as low density polyethylene (LDPE) for the closure, taking advantage of the unique properties of LDPE. In these cases, if one wishes to employ a threaded closure, the classic one turn "rule-of-thumb" may not be adequate to ensure proper retention of the applied closure. This is a result of the added flexibility of thin walling or the inherent relative flexibility of the LDPE materials. In some cases a minimal amount of internal container pressure, such as that experienced when the container may be dropped, is sufficient to cause the closure skirt to expand to the point where the closure simply pops off. This flexibility can also allow localized distortion of the closure to the point where the closure threads "strip" relative to the mating container threads. This stripping action normally initiates at the bottom end of the closure thread where the hoop strength of the closure is at a minimum. At that position, radial distortion of the closure skirt allows disengagement of the mating threads. Continued torquing causes the disengagement to proceed helically upward in a "tiring" manner until finally the mating threads "jump" over each other. This stripping mechanism is not only of concern on initial application, where such stripping can result in an unseated closure, but also in the hands of the consumer expecting reseal integrity.

In order to adjust for the inherent flexibility of LDPE materials, designers have often chosen to dramatically increase the circumferential extent of mating thread engagement. However, when maintaining a single lead thread, the amount of turning required to apply and remove the closure can become excessive for rotary capping and/or convenient consumer manipulation. These concerns can be addressed by using multiple lead threads. In this case, the total thread engagement approximates the sum of the circumferential extent of each of the multiple leads. In addition, the multiple leads are circumferentially distributed around the lower portion of the closure skirt to thereby balance the distortional forces involved in closure torquing. On the other hand, multiple lead threads normally require an increased helical angle (vs. horizontal) for the thread and/or an uniformly finer thread. An increased helical angle can lead to closure back-off or unintentional unthreading or even loosening of the thread. In addition, an uniformly finer thread will decrease the amount of radial thread overlap thereby reducing the ability of the system to withstand closure distortions. Such threads will also promote cross threading during application due to the decrease target presented to the closure thread lead by the reduced container thread pitch.

It is clear to those skilled in the art that substitution of LDPE materials for more rigid materials, while accomplishing benefits unique to LDPE, also involves performance tradeoffs which cannot always be recovered by the alternate designs advanced to date.

Additional problems have arisen recently when attempts have been made to employ certain closure designs using certain capping practice. These problems can be broadly categorized as associated with the capping process as opposed to the material choices for the package components.

A first method of capping, known in the industry, involves a "pick and place" operation. This method includes positive positioning of a closure within a gripping chuck which is then moved directly over a container. The chuck is simultaneously turned and moved axially toward the container to screw the closure onto the container finish. This application method is similar to actual manual application. Further details of this application method appear in the "Detailed Description Of Preferred Embodiments" which follows in the Specification.

An alternate, less expensive, approach to closure application can be characterized as a "pickoff" operation. During "pickoff" a closure is held in a chute and positioned at an angle relative to the axis of a container finish that passes beneath the closure. The container finish comes into contact with the closure and picks it off the chute. Unfortunately, the "pickoff" approach can lead to certain difficulties associated with structural design and material selection as will be more fully explained herein in association with prior art FIG. 4. These difficulties and the novel solutions are more fully described in the "Detailed Description of Preferred Embodiments" to follow.

SUMMARY OF THE INVENTION

In a first embodiment of the present invention, a unique neck finish for a container is provided. The neck finish includes a substantially cylindrical exterior wall surface surrounding an orifice defined in the container and includes a thread structure positioned about the exterior wall surface. The thread structure has at least a first portion and a second portion. Each portion has a corresponding effective maximum diameter, wherein the effective maximum diameter of the first portion is less than the effective maximum diameter of the second portion.

Further elements of the first embodiment may include providing a neck finish wherein the first portion is positioned axially above the second portion. Alternatively, the thread structure may have a convex surface projecting radially outwardly from the exterior wall surface. The thread structure may also have an effective maximum diameter that continuously increases from the first portion to the second portion, or that incrementally increases from the first portion to the second portion, or that selectively increases from the first portion to the second portion.

In a second embodiment of the present invention a neck finish for a container is provided and has a substantially cylindrical exterior wall surface surrounding an orifice and has a thread structure. The thread structure has multiple portions of convex surface regions projecting radially outwardly from the exterior wall surface. Each of the portions has a point of maximum separation from the exterior wall surface. The point of maximum separation also defines an effective maximum diameter associated with the portion. A selected first portion has an effective maximum diameter less than a selected second portion positioned axially below the first portion.

Additional elements of the second embodiment may provide for multiple portions being positioned to form a helical path extending circumferentially around the exterior wall surface and being characterized by having a maximum effective diameter of a portion positioned at an upper segment of the helical path being less than the maximum effective diameter of a portion positioned at a lower segment of the helical path.

In a third embodiment of the present invention a neck finish for a container is provided in combination with a container closure. The neck finish is defined as having an upper orifice that defines an opening, a downward extending neck wall below the opening, a thread structure positioned on the exterior of the neck wall, and a first bead-like structure surrounding the neck wall positioned axially below the thread structure. The thread structure has a first portion and a second portion positioned axially below the first portion. The first and second portions have a corresponding effective maximum diameter such that the effective maximum diameter of the first portion is less than the effective maximum diameter of the second portion. The container closure has a top, a downwardly extending skirt portion depending from the top. The skirt portion has an interior, and a radially inwardly projecting member adapted for engagement with the first bead-like structure, such as a second bead-like structure or a J-band structure, positioned within the interior of the skirt portion.

The third embodiment may include other elements such as providing a thread structure to include multiple portions positioned to form a helical path extending circumferentially around the exterior of the neck wall and characterized by having a maximum effective diameter of a portion positioned at an upper segment of the helical path being less than a maximum effective diameter of a portion positioned at a lower segment of the helical path. Alternatively, a clearance space may be provided when the container closure is initially applied to the container neck for closing. The clearance space would be disposed between an upper edge of the exterior of the neck wall and a free edge of the interior of the skirt portion. The clearance space may provide decreased interference or increased clearance with said first portion, and/or provide resistance to stripping under the action of torque applied to said container closure.

The radially inwardly projecting member on the container closure may include a tamper-evidencing band frangibly connected to the downwardly extending skirt portion and having an inwardly and upwardly turned retaining rim adapted for engagement with the first bead-like structure.

In a fourth embodiment of the present invention, a method of applying a threaded cap to a threaded neck of a container is disclosed. The method includes providing a threaded neck of a container that includes thread structure having a first portion and a second portion positioned axially below said first portion. The first and second portions have a corresponding effective maximum diameter such that the effective maximum diameter of the first portion is less than the effective maximum diameter of the second portion. The threaded neck further includes a neck wall having an exterior with a bead-like structure surrounding the neck positioned axially below the thread structure. Next, a threaded cap is placed at an angle offset from a vertical axis defined by the threaded neck. Then, the container and/or the cap are moved towards each other such that a neck edge defined by the exterior of the neck wall comes into contact with a cap edge defined by an interior wall of the cap, wherein upon contact a clearance space is defined between an upper edge of the exterior defined by the neck wall and a free edge of the interior wall of the cap. Next, the container and/or cap are further moved towards each other with the cap in contact therewith. Last, the cap is leveled onto the threaded neck of the container such that the cap axis is urged towards a substantially vertical position on the threaded neck. The fourth embodiment may further include contacting the cap with a skid plate or roller to level and align the cap and container to one another. Additionally, it may include urging a tamper-evidencing band defined on the cap vertically downward past the thread structure and/or urging the tamper-evidencing band over the bead-like structure surrounding the neck wall. In addition, a step may be included to screw the cap on the container in complimentary threaded engagement, or to snap the cap on the container in complimentary threaded engagement by axial force.

The present invention has a number of embodiments any one of which may or may not include a number advantages over the prior art. One advantage is to teach an inventive container finish contributing to the facile application of closures incorporating depending tamper evidencing band structure. Another advantage is to improve the integrity, seal, and reliability of threaded closure systems while maintaining consumer ease of use. A further advantage is to permit choice of low density materials for threaded closures while eliminating some detrimental consequences previously accompanying such a choice.

Numerous other advantages and features of the invention will become readily apparent from the following detailed description of the invention and the embodiments thereof, from the claims, and from the accompanying drawings.

BRIEF DESCRIPTION OF THE FIGURES

A fuller understanding of the foregoing may be had by reference to the accompanying drawings, wherein.

DETAILED DESCRIPTION OF PREFERRED EMBODIMENTS

Figure 1:
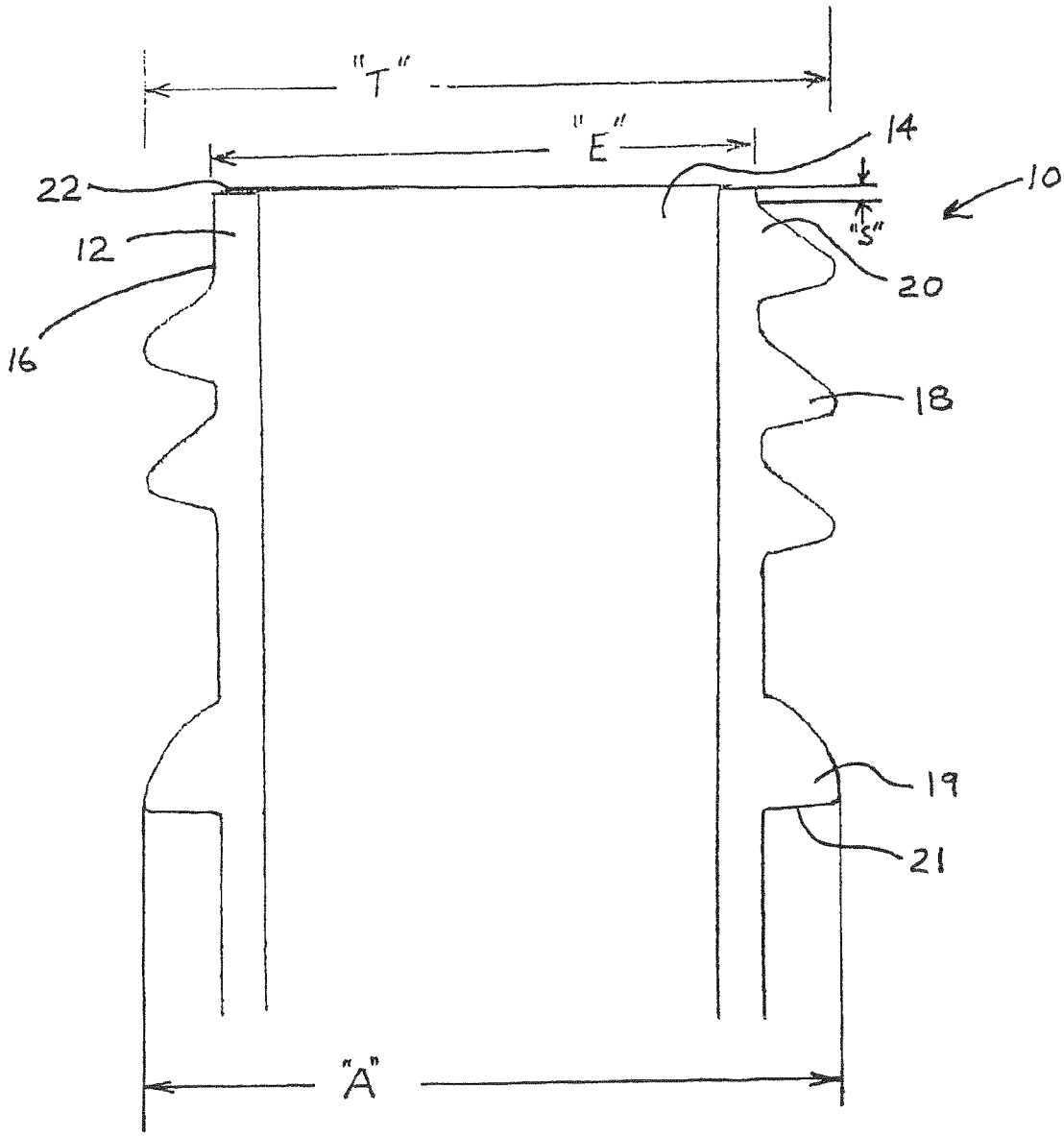
FIG. 1 (PRIOR ART)
FIG. 1 is a side elevational view, partially in section, of a typical prior art container finish.

The embodiments of the invention will now be described in detail in conjunction with the descriptive figures. While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or the embodiments illustrated.

Referring now to FIG. 1, there is shown a side elevational view partially in section of a portion of a typical container finish according to the prior art. Finish 10 has a cylindrical base structure 12 surrounding an orifice 14. The base structure 12 has an exterior wall 16 that further defines an exterior diameter of the wall 16, commonly referred to as the "E" diameter. Correspondingly, the wall 16 is commonly referred to as the "E wall" of the finish 10. In the prior art embodiment shown, the "E wall" has a substantially constant diameter over the entire vertical extent of the finish 10. This uniform diameter is not a requirement for prior art finishes. Positioned on the "E wall" and protruding radially outwardly therefrom is a thread structure 18.

The thread structure 18 can take many sectional forms as is known in the art. In addition, the thread structure 18 can comprise multiple leads and various pitches as is known in the art. The diameter defined by the exterior projection of the thread structure 18 is commonly referred to as the "T diameter". The effective "T" diameter is twice the radial distance from the finish axis to the point of maximum projection at a particular position along a helical thread path or horizontally directed bead. The upper portion of the thread structure 18 has an upper thread start indicated by numeral 20. The vertical distance between the uppermost point of thread structure 18 and the uppermost point on top surface 22 of base structure 12 is commonly referred to as the "S dimension" of the finish 10, as shown.

Below the thread structure 18 there is often present a retention bead-like structure 19 outwardly projecting from the "E wall". As is known in the art, this retention bead-like structure 19 serves as a retention feature, cooperating with suitable structure defined on a cap, as later discussed herein, such as a closure tamper evidencing band to retain the band during initial closure removal. The diameter defined by the maximum extent of this retention bead-like structure is commonly referred to as the "A diameter" as shown.

Figure 2:
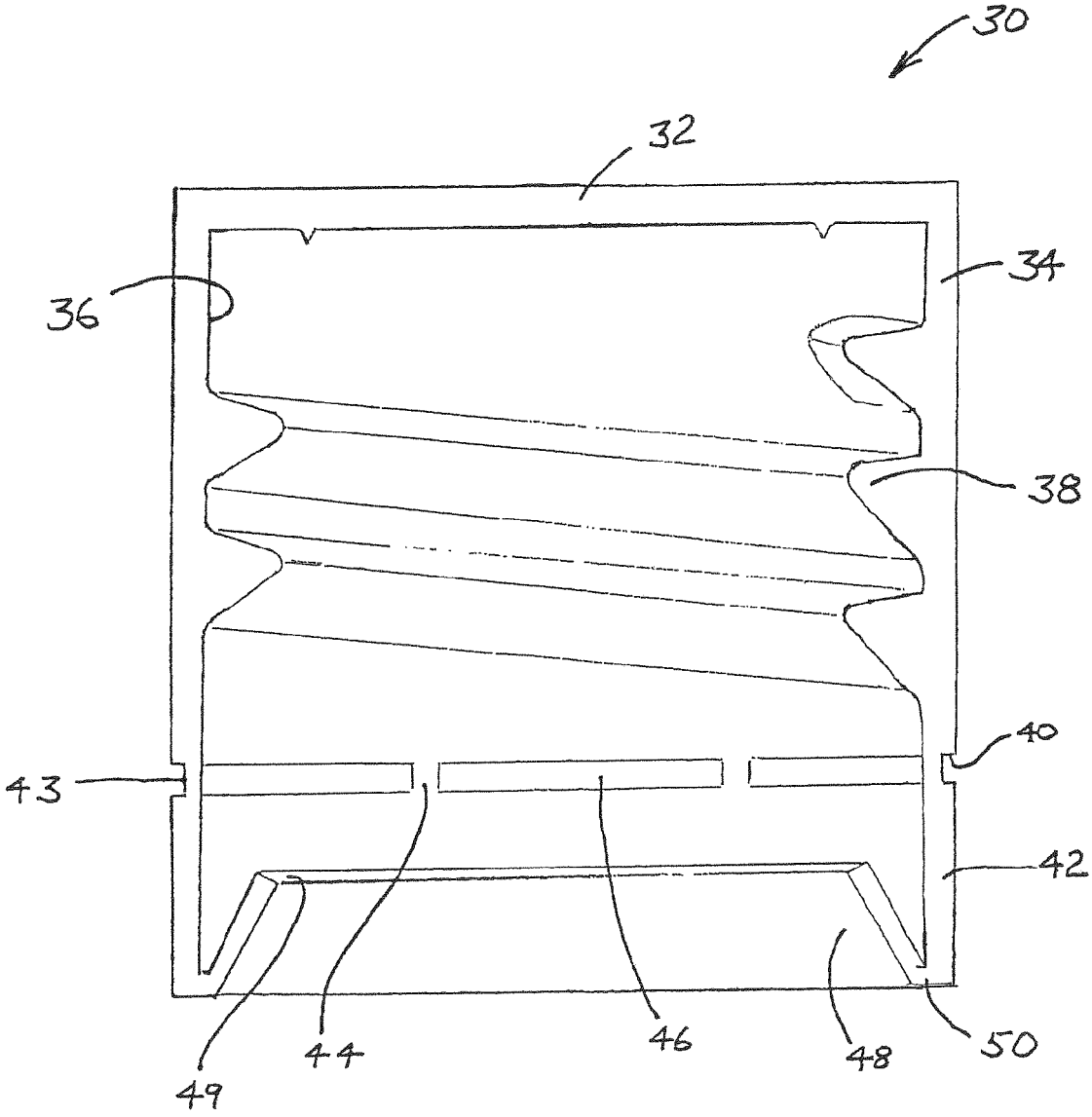
FIG. 2 (PRIOR ART)
FIG. 2 is a side elevational view, partially in section, of a prior art threaded closure.

Referring now to FIG. 2, there is shown a side elevational view, partially is section, of a portion of a typical prior art closure 30. The closure 30 has a generally disk-like top 32. Depending from the top 32 is a cylindrical skirt 34 that has an inner wall 36. An internal thread structure 38 projects inwardly from the inner wall 36. The internal thread structure 38 can take many sectional forms as is known in the art. In addition, the internal thread structure 38 can comprise multiple leads, various pitches, etc. as is known in the art. Often, prior art closures further comprise a tamper evidencing band depending from the lower edge 40 of the cylindrical skirt 34 through a frangible attachment. Such a tamper evidencing band is indicated in the simplified FIG. 2 embodiment by numeral 42. In the FIG. 2 embodiment, the tamper evidencing band 42 is connected to the cylindrical skirt 34 through a frangible line of weakness 43. The frangible line of weakness 43 comprises multiple bridges 44 separated by spaces 46 extending around the circumference of the closure 30. The particular band structure of the FIG. 2 closure is a "J-band" type. Further details of the structure and operational aspects of the "J-band" type tamper evidencing band can be found in the U.S. Pat. No. 6,484,896, the disclosure of which is hereby incorporated herein in its entirety by reference. The tamper evidencing band 42 includes an inwardly-upwardly directed flange 48, which has an upper free edge 49. The flange 48 can pivot around a thin hinge-like connection 50 thereby allowing the effective diameter defined by free edge 49 to expand or contract somewhat easily.

When combining a prior art closure, such as that of FIG. 2, with a prior art finish, such as shown in FIG. 1, one will recognize that the corresponding threads should have compatible structural characterization such that they mesh or mate in the complementary intended fashion.

Figure 3:
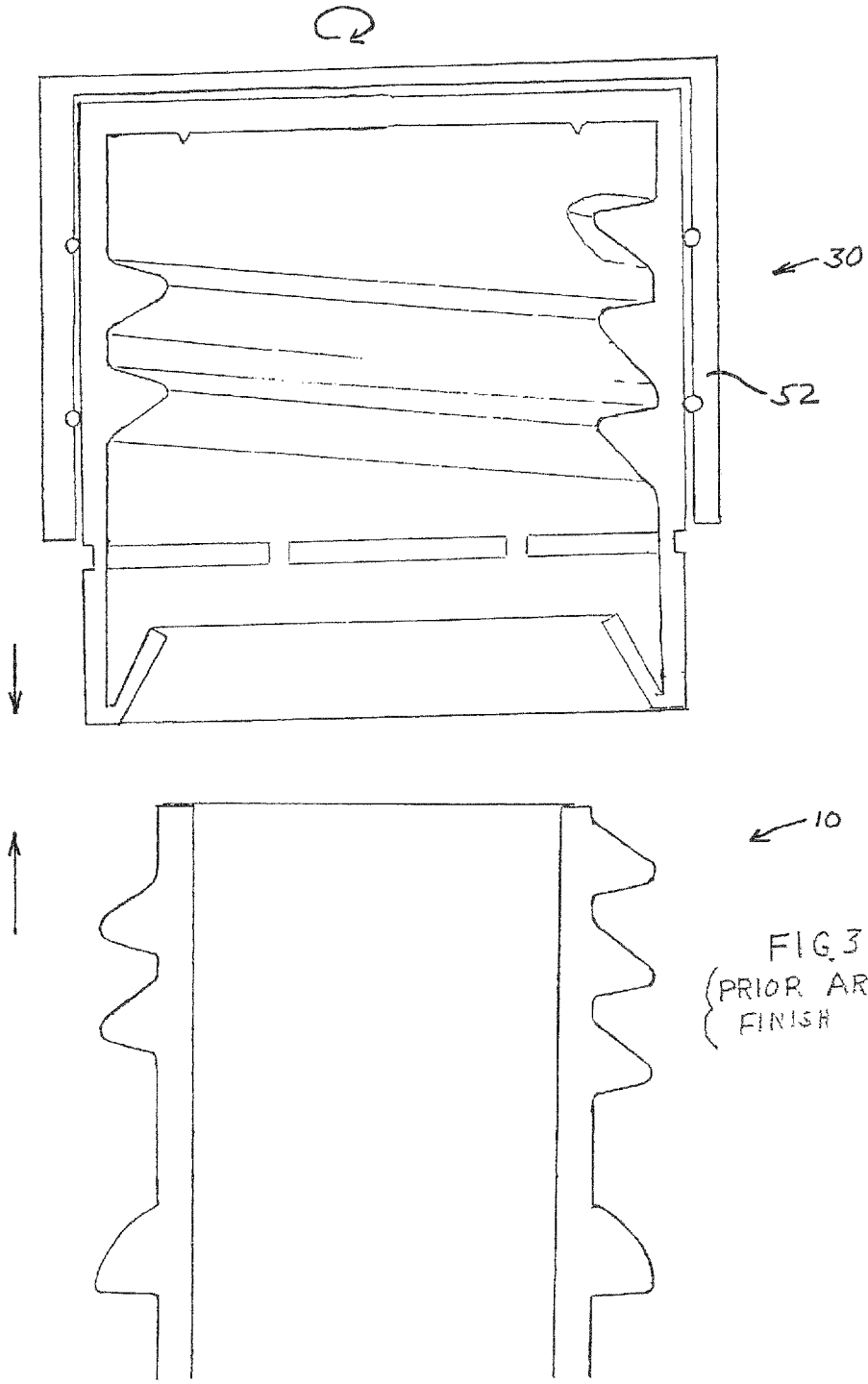
FIG. 3 (PRIOR ART)
FIG. 3 is a side elevational view showing a condition that exists during application of the closure of FIG. 2 to the container finish of FIG. 1 when using one method of closure application.

Turning now to FIG. 3, there is embodied one method of applying closure 30 to container finish 10. The FIG. 3 embodiment shows that the closure 30 is firmly grasped within the concavity of chuck 52. Various methods of achieving such secure and positive closure placement within such a chuck 52 are known in the art. The chuck and closure are moved to a position, such as depicted in FIG. 3, where the axes of the closure and container are effectively co-linear. Subsequently, relative axial motion (closure moves down or container moves up) accompanied by relative rotation causes the closure to be positively screwed onto the container finish. After application is complete, the chuck releases its grip on the closure. This "pick and place" application of a closure to a container is very effective and reliable, simulating actual manual application. Unfortunately, factors such as equipment costs and spatial requirements may prohibit this approach.

Figure 4:
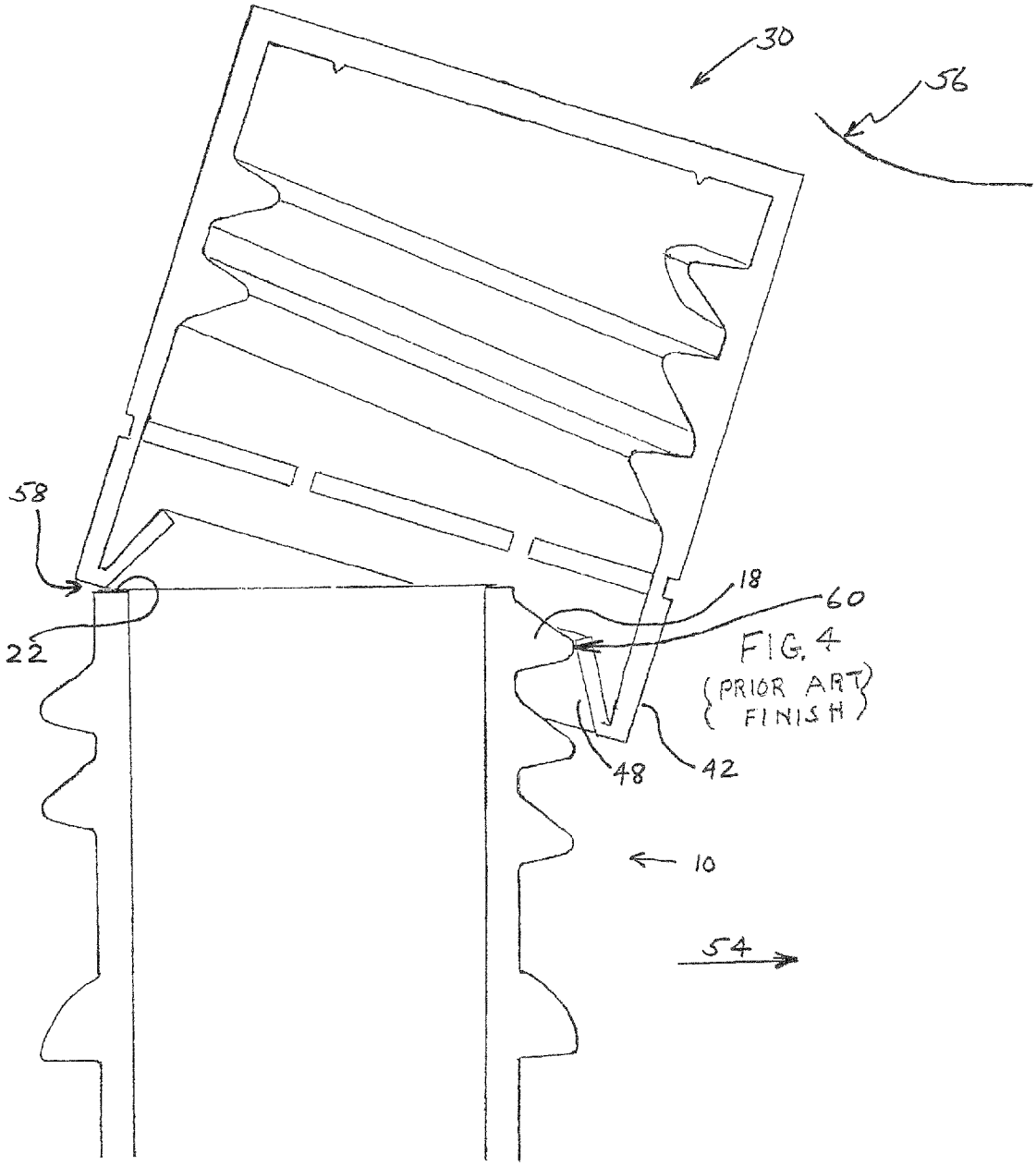
FIG. 4 is a side elevational view showing a condition which may result using a alternate method to apply the closure of FIG. 2 to the container finish of FIG. 1.

An alternate, less expensive, approach to this closure application can be characterized as a "pickoff" application as illustrated at prior art FIG. 4 discussed hereafter. The "pickoff" approach envisions a cap chute functioning to position a closure at a defined angle relative to the axis of a container finish passing beneath the chute. This is commonly referred to as the "pickoff" position. The vertical height of the closure retained by the chute is adjusted such that the closure finish contacts the lowermost edge of the closure skirt or tamper evidencing band while passing beneath the chute, thereby "picking" the closure from the chute. Following closure pickoff, the container normally passes under a device such as a skid plate or roller functioning to level and align the closure and container axes and to loosely affix the aligned closure to the container using relatively light vertical pressure. The container/closure combination is then transported to a subsequent application station to fully seat the closure. In the case of a snap-on closure, this application station can take the form of a simple mechanism applying axial force to the closure. Thus this method has enjoyed widespread favor for applying snap-on closures.

In the case of a screw-on closure, the application station following "pickoff" may consist of various mechanisms to impart relative rotation between the closure and container. In many cases rotation alone is expected to result in proper threading and seating of the closure. Thus if the pickoff is not adequately "square" cross-threading can be a problem. In other cases, if the closure is insufficiently seated during pickoff, the closure and container threads may have insufficient vertical overlap to properly mesh as a result of simple rotation. In these cases more complicated top loading may be required. Those skilled in the art will recognize that while the "pickoff" method employs relatively simple, inexpensive equipment compared to rotary chuck application, many more closure/container design factors must be proper to achieve satisfactory "pickoff" closure application.

Regarding the "pickoff" method of closure application, some closure designs, particularly certain tamper evident closure designs, present additional difficulties. Many of the tamper evident closure concepts incorporate a tamper evidencing band depending from the lower edge of the primary closure skirt through a frangible connection.

One such design that is particularly effective in its tamper evidencing performance is the "J-Band" design illustrated in the simplified embodiment of FIG. 2. One form of this design concept is taught and illustrated in much greater detail in U.S. Pat. No. 6,484,896 ('896" patent) to Ma, the entire contents of which are herein incorporated by reference. The "J-Band" closures taught in the "896" patent include a tamper evidencing band comprising an upwardly-inwardly extending annular flange whose free edge ultimately engages the lower surface 21 of a container bead (such as retention bead-like structure 19 of FIG. 1) upon completion of initial application of the closure to the container. The flange may incorporate pleats which allow the flange free edge to easily diametrically expand during downward movement over a container bead restriction but to assume a substantially reduced effective diameter as it relaxes to its unstressed state following passage past the bead. The function of the tamper evidencing band is enhanced by the large changes in effective diameters of the free edge of the flange responding to minimal expansion forces. The embodiments discussed herein can be applied when using many other closures incorporating the basic "J-Band" concepts, including both threaded closures and "snap-on" closures.

One skilled in the art will recognize that in general there will exist an optimal value for the difference in effective diameters for the flange free edge between the fully expanded and relaxed conditions. However, as will be shown, the appropriate diameter in the relaxed condition has considerable influence on the ability of such a closure to be properly applied by the "pickoff" method.

Turning now to FIG. 4, there is shown a "snap-shot" view of a hypothetical condition existing during a prior art "pickoff" application. The container finish 10 of FIG. 1 is about to "pick" the closure 30 of FIG. 2 from a retaining device (not shown). The finish 10 has its axis directed substantially vertically and is proceeding to the right in the FIG. 4 (direction of arrow 54 in the figure) while maintaining the vertical axial orientation. The closure 30 is in a position such that its axis is inclined to the vertical, and is held in this position by a closure "pickoff" retainer (not shown). As the finish 10 moves to the right, it contacts the inwardly-upwardly directed flange 48. The closure 30 thus is pulled away from the pickoff retainer and attempts to assume a position covering the top end 22 of finish 10. This positioning is often assisted by passing the assembly under a leveling device such as that depicted in FIG. 4 by numeral 56 which applies slight downward pressure urging the closure axis toward a substantially vertical position.

However, as is seen in the prior art FIG. 4 "snapshot", vertical positioning of the closure 10 axis is prevented by the abutment of the trailing portion of tamper band 42 and the uppermost portion 22 of finish 10 at the position indicated by arrow 58 in the FIG. 4 embodiment. This abutment is a consequence of the contact between the finish thread 18 and the flange 48 of tamper band 42 at the point indicated by arrow 60. The contact at position 60 urges the closure 30 to move ahead of the container finish and thus discourages the closure axis from assuming a co-linear positioning with the finish axis. The abutment at arrow 58 prevents the leveling device 56 from "squaring" the closure 30 into a resting position covering the top open end of finish 10. The cocked closure may be crushed or the container tipped over by the leveling device. Alternatively, for example, in the case of soft PE gallons and half gallons, the bottle simply is too weak to counteract the forces and merely deforms and is unable to recover during the torque phase resulting in the same cross threading. Still further, should a cocked closure arrive at a final rotary application station, a badly skewed, cross threaded cap can result.

One will understand that, while the "pickoff" problems illustrated in the snapshot view of prior art FIG. 4 used a threaded "J-Band" closure, similar problems can occur with other inwardly projecting tamper evidencing structure when combined with outwardly projecting container finish structure in a "pickoff" operation. The embodiments discussed herein are not limited to those features associated with "J-Band" structure. Rather, the embodiments of FIGS. 5 through 9 contemplate a container closure having a top and a downwardly extending skirt portion depending from the top wherein the skirt portion has an interior having a radiallly inwardly projecting member 43 (see FIGS. 6 and 7) which may, for example, take the form of either a "J-Band" structure (as in 42, 48, and 49 of FIGS. 5 through 8) or a second bead-like structure (as in 45 of FIG. 8*a*) which can be adapted for engagement with an outwardly projecting container finish such as retention bead-like structure 19 surrounding the neck wall of the neck finish that is positioned axially below the thread structure.

Figure 5:
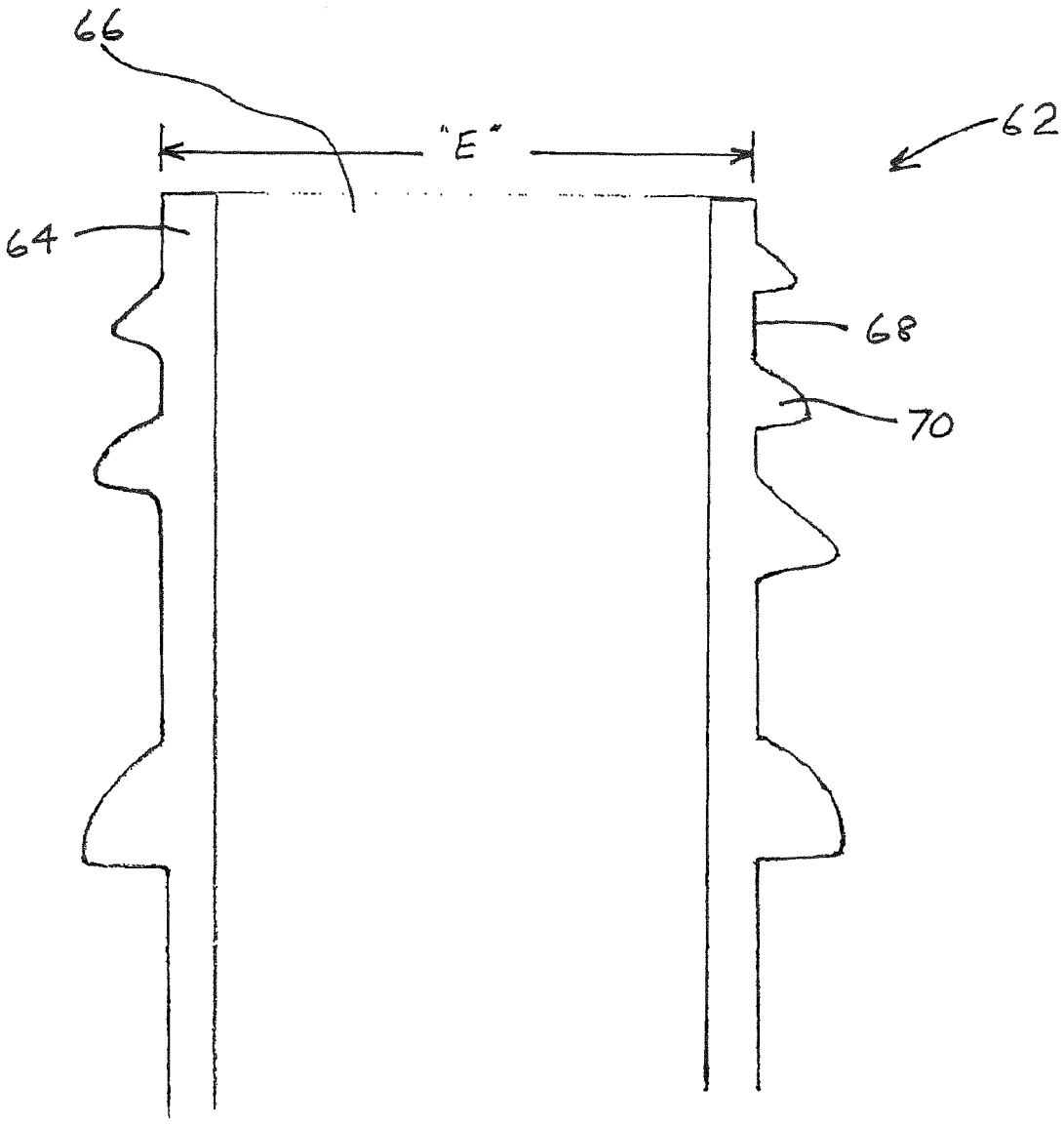
FIG. 5 is a side elevational view, partially in section, of a novel container finish according to an embodiment of the present invention wherein the thread structure has a variable outward projection as it traverses its vertical helical path.

Turning now to FIG. 5, there is shown in partial section a neck finish 62 in accordance to one embodiment of the present invention. In FIG. 5, neck finish 62 comprises a substantially cylindrical wall 64 defining and surrounding an orifice 66. The wall 64 has an exterior surface 68 which defines a diameter, the "E-Wall" diameter of the finish 62. The "E-Wall" diameter is as indicated in FIG. 5. In the FIG. 5 embodiment, the "E-Wall" diameter is essentially constant throughout the vertical extent of finish. However, the "E-Wall" diameter may not necessarily be constant in all embodiments. Projecting radially outwardly from the "E-Wall" is thread structure 70. In contrast to the thread structure of the prior art finish of FIG. 1, the thread structure of the FIG. 5 embodiment has a variable outward projection as it traverses its vertical helical path. In the FIG. 5 embodiment, the radial extent of the thread projection is at a minimum at the upper thread portion and at a maximum at the lower end of the thread. Thus, the thread can be characterized as having a variable effective "T" dimension.

Figure 5A:
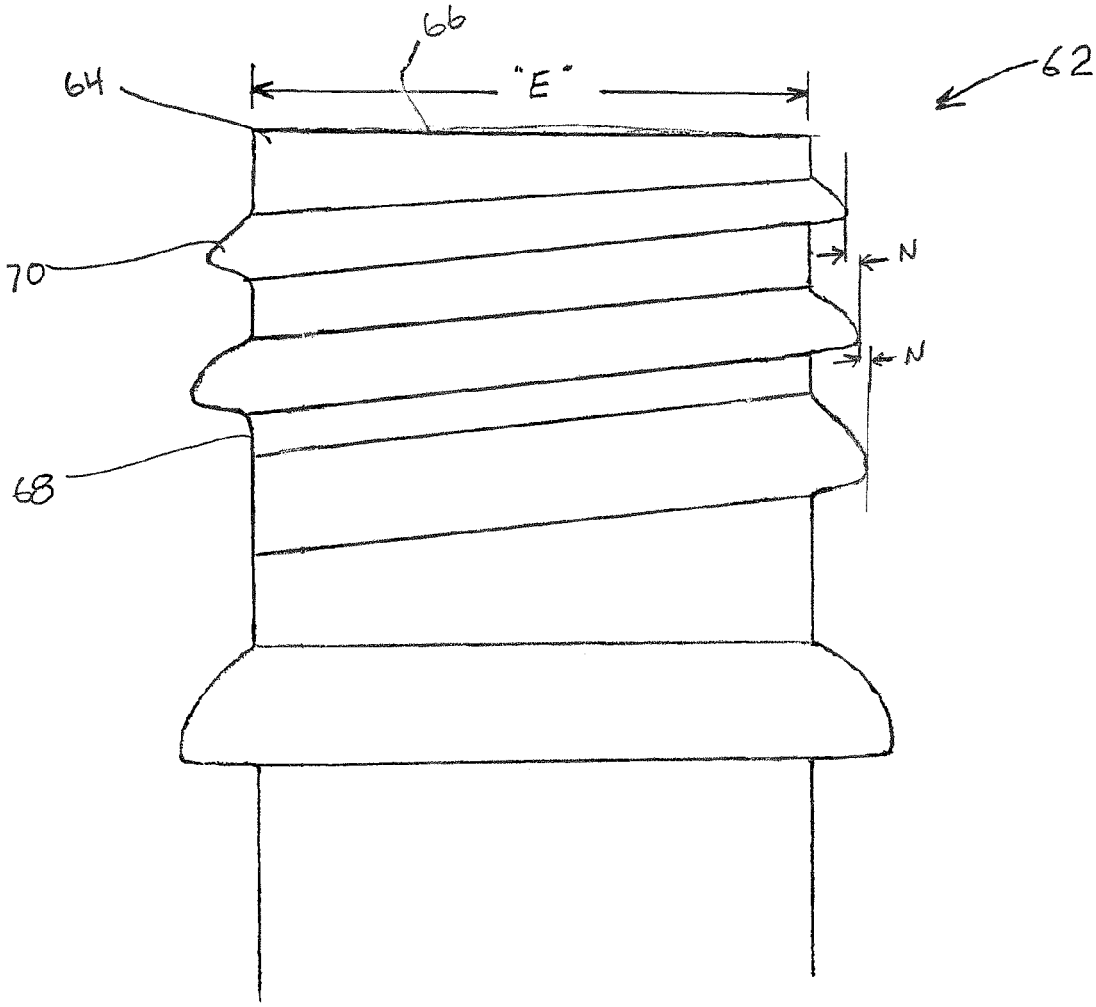
FIG. 5*a* is a side elevational view, partially in section, of a novel container finish according to an embodiment of the present invention wherein the variable outward projection of the thread structure incrementally increases as it traverses its vertical helical path.
Figure 5B:
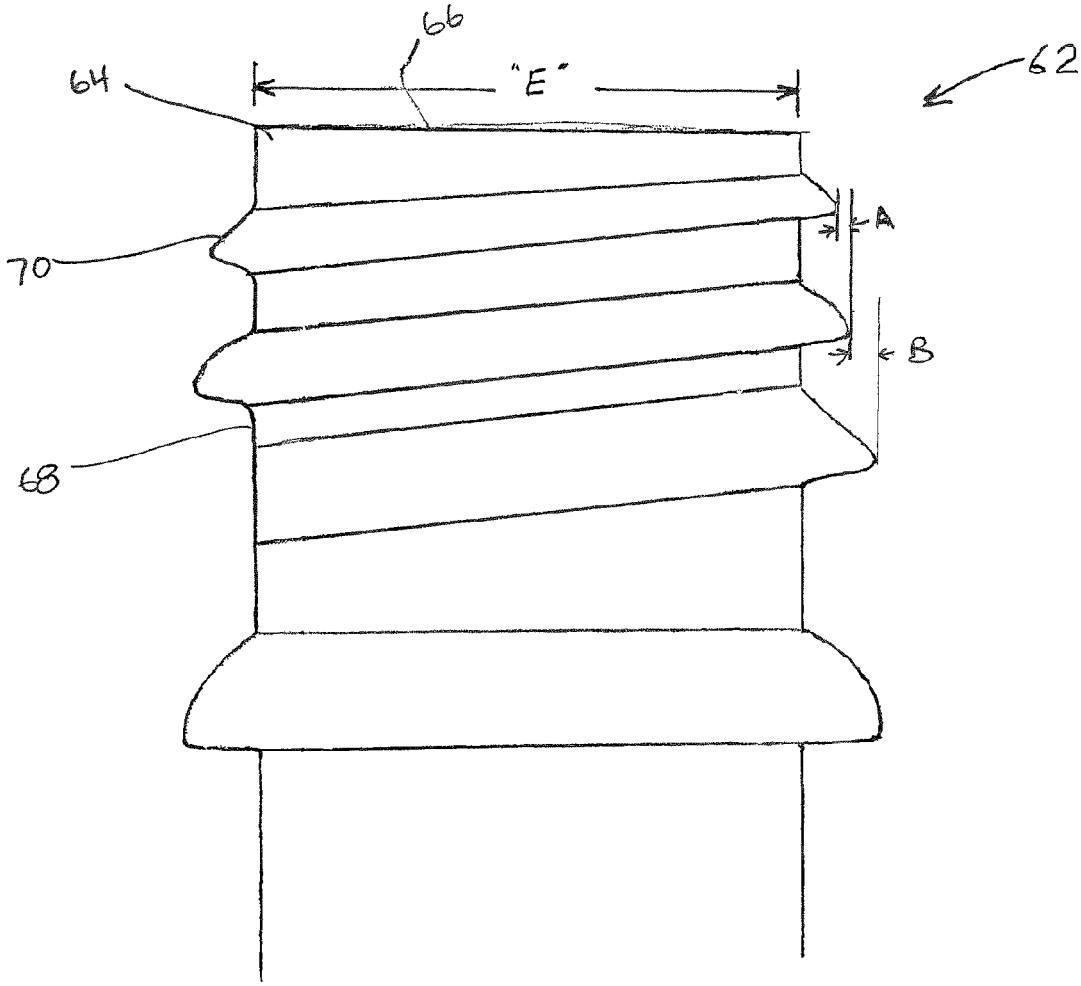
FIG. 5*b* is a side elevational view, partially in section, of a novel container finish according to an embodiment of the present invention wherein the variable outward projection of the thread structure selectively increases as it traverses its vertical helical path.

In FIG. 5, the thread structure 70 is shown as having a single lead and having a "modified buttress" type section. Other types of thread form, for example multi-lead thread structure, segmented threads and symmetric sections, may be incorporated in the embodiments discussed herein. In addition, the embodiments discussed herein contemplate other types of radially projecting structure such as essentially horizontal segmented or continuous retaining beads associated with snap-on closure systems. As illustrated in FIG. 5 the retaining structure projecting from the "E-Wall" defines a variable effective "T" dimension which is smaller in an upper region of the structure compared to a lower region. In the FIG. 5 embodiment, the effective "T" dimension is depicted as continuously increasing as the thread traverses vertically downward. However, the "T" dimension can increase during the downward travel in increments (illustrated in FIG. 5*a* as an incremental increase of a number N) or selectively (illustrated in FIG. 5*b* as a first increase by a first number A, and a second increase by a second number B) as compared to the continuous increase of the FIG. 5 embodiment.

Figure 6:
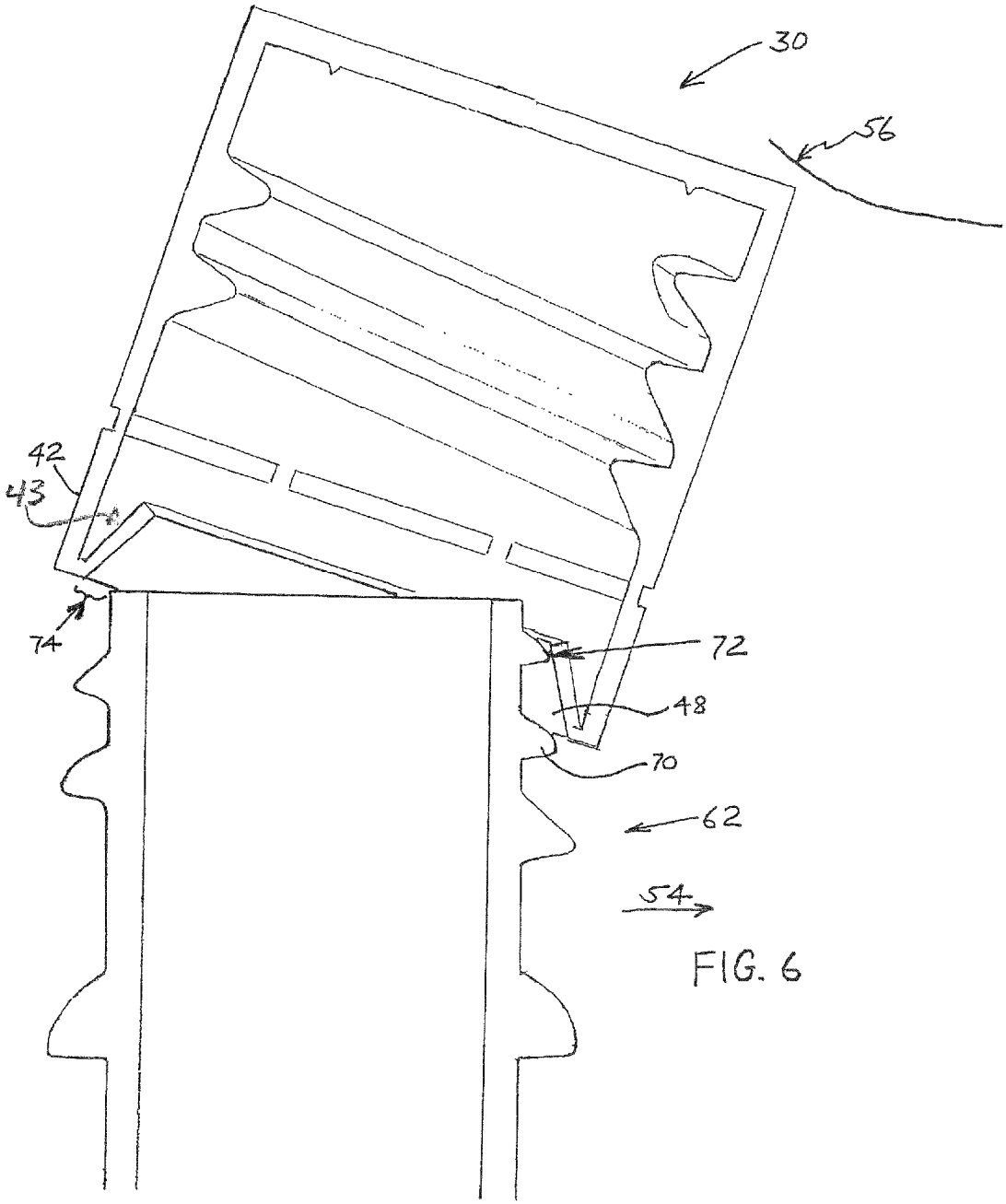
FIG. 6 is a side elevational view showing application of the closure of FIG. 2 to the container finish of FIG. 5 when using the closure application method embodied in FIG. 4.

Referring now to FIG. 6, there is shown the effect of substituting the novel neck finish embodied in FIG. 5 for the prior art finish of FIG. 1. FIG. 6 is a "snapshot" of a condition occurring during a "pickoff" operation relative at a position similar to that of prior art FIG. 4. It is seen in FIG. 6 that at "pickoff" the initial contact is made between flange 48 of closure 30 and thread structure 70 of novel finish 62 at the point identified by arrow 72 in the figure. However, because of the reduced effective "T" dimension of the thread structure 70 in this upper portion, the trailing edge of tamper band 42 of closure 30 is not urged forward to the extent associated with the abutment at arrow 58 of the structural arrangement embodied in prior art FIG. 4. Thus there is considerable clearance between the trailing edge of tamper band 42 and the trailing upper edge of the "E-Wall" of finish 62 in the region generally indicated by arrow 74 in FIG. 6. With the possible assistance of a leveling device, such as leveling plate or roller 56, the closure 30 easily is maneuvered to a resting position squarely covering the open end of novel container finish 62. Another problem solved by one or more of the embodiments is that without the space 74 the "J band" can interact with the threads and the horizontal nature of the threads can override or affect the normal helical engagement of the threads.

Figure 7:
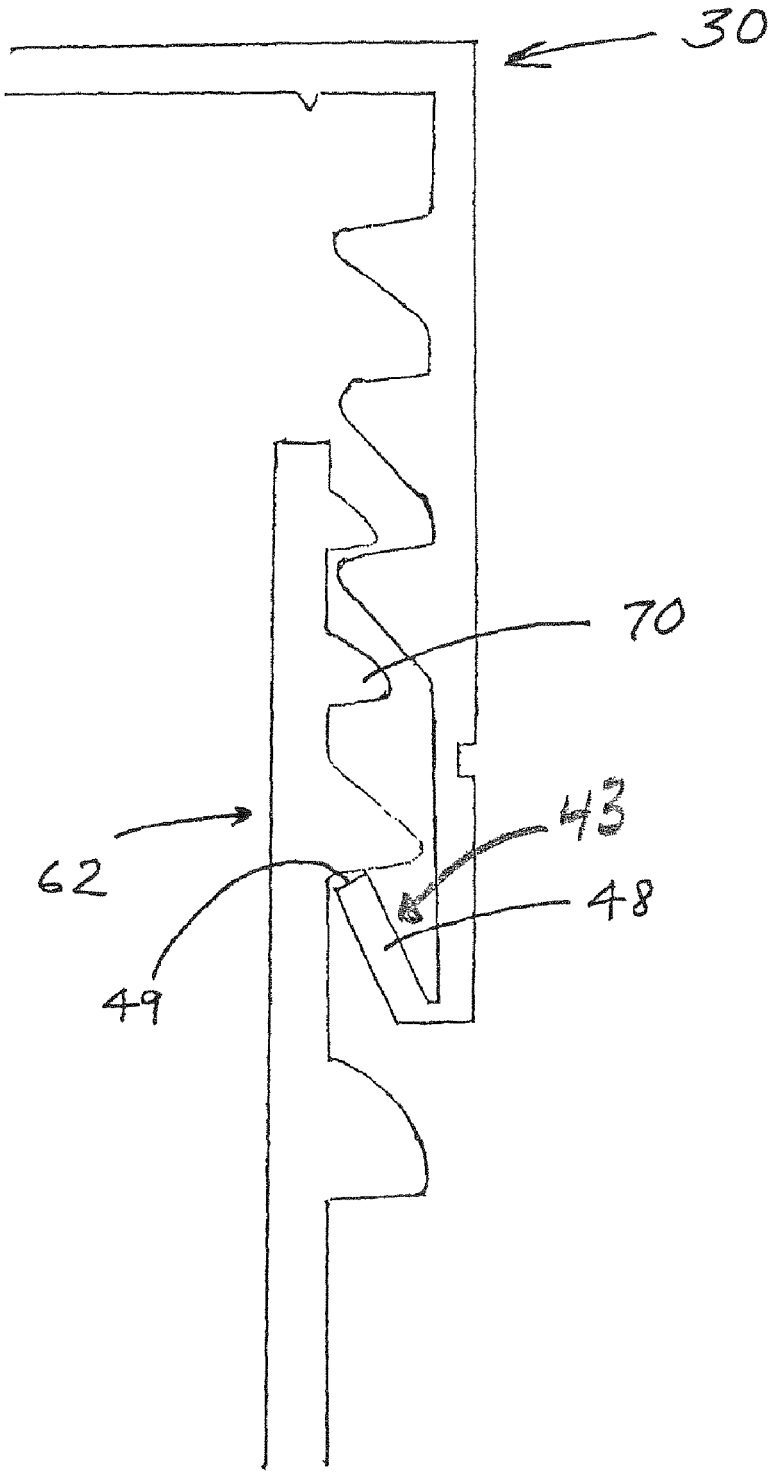
FIG. 7 is a side elevational view showing a combination of the container finish of FIG. 5 combined with the closure of FIG. 1 at an intermediate point during application of the closure.

The latter resting position of the closure following pickoff is illustrated in FIG. 7. Here it is shown that the closure 30 has been urged vertically downward over the finish 62, such as by contact of the cap with the leveling pate or roller 56 of FIG. 6, to the point where flange 48 has been caused to traverse the entire vertical extent of thread structure 70. Moreover, the upper free edge 49 of flange 48 rests under a lower portion of thread structure 70 helping to retain the closure in a square position with it axis effectively vertical. This retention not only maintains closure positioning but also prevents closure/container separation due to jostling or product foaming etc. until a final screw or snap application station is reached.

Figure 8:
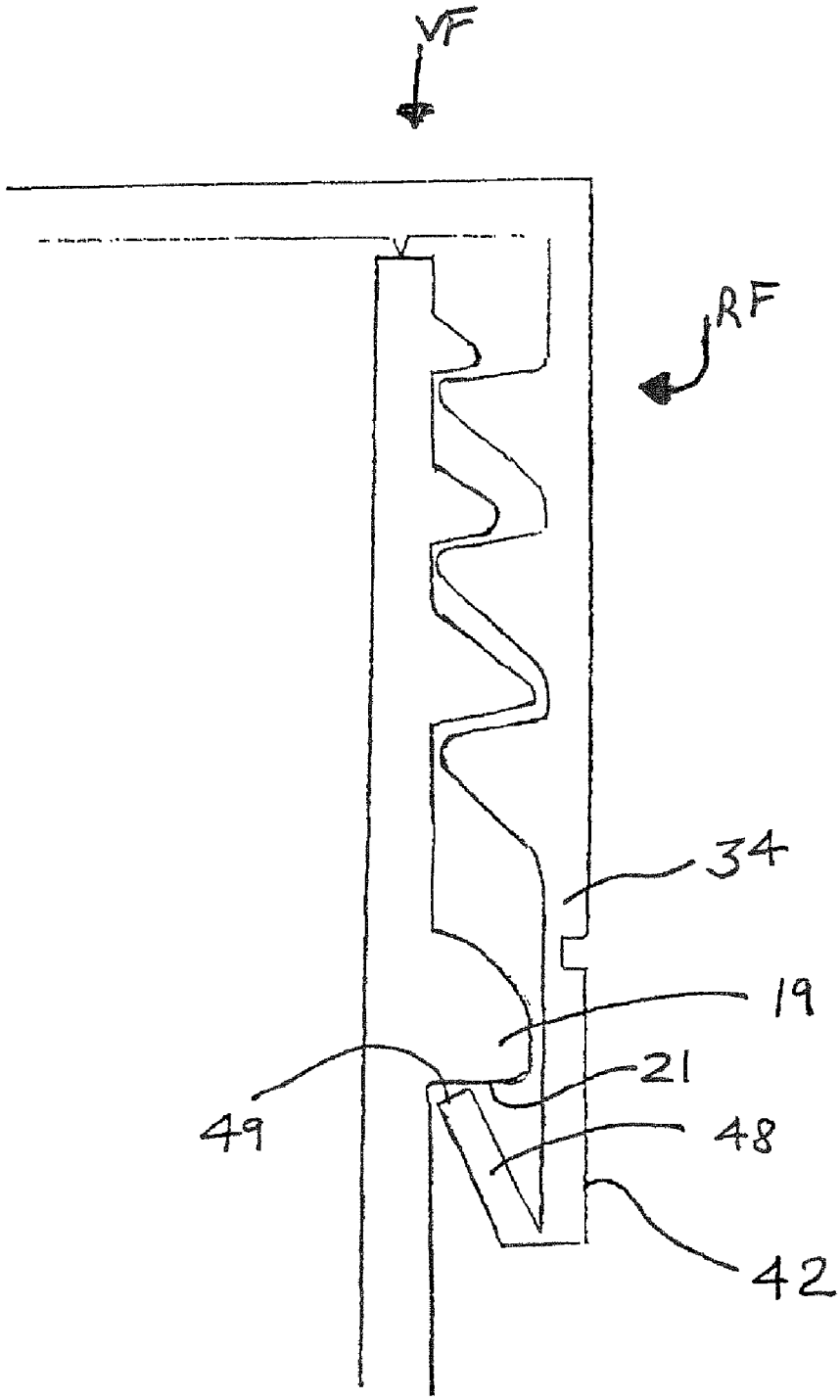
FIG. 8 is a side elevational view showing the combination of the closure of FIG. 2 after complete application to the container finish of FIG. 5.
Figure 8A:
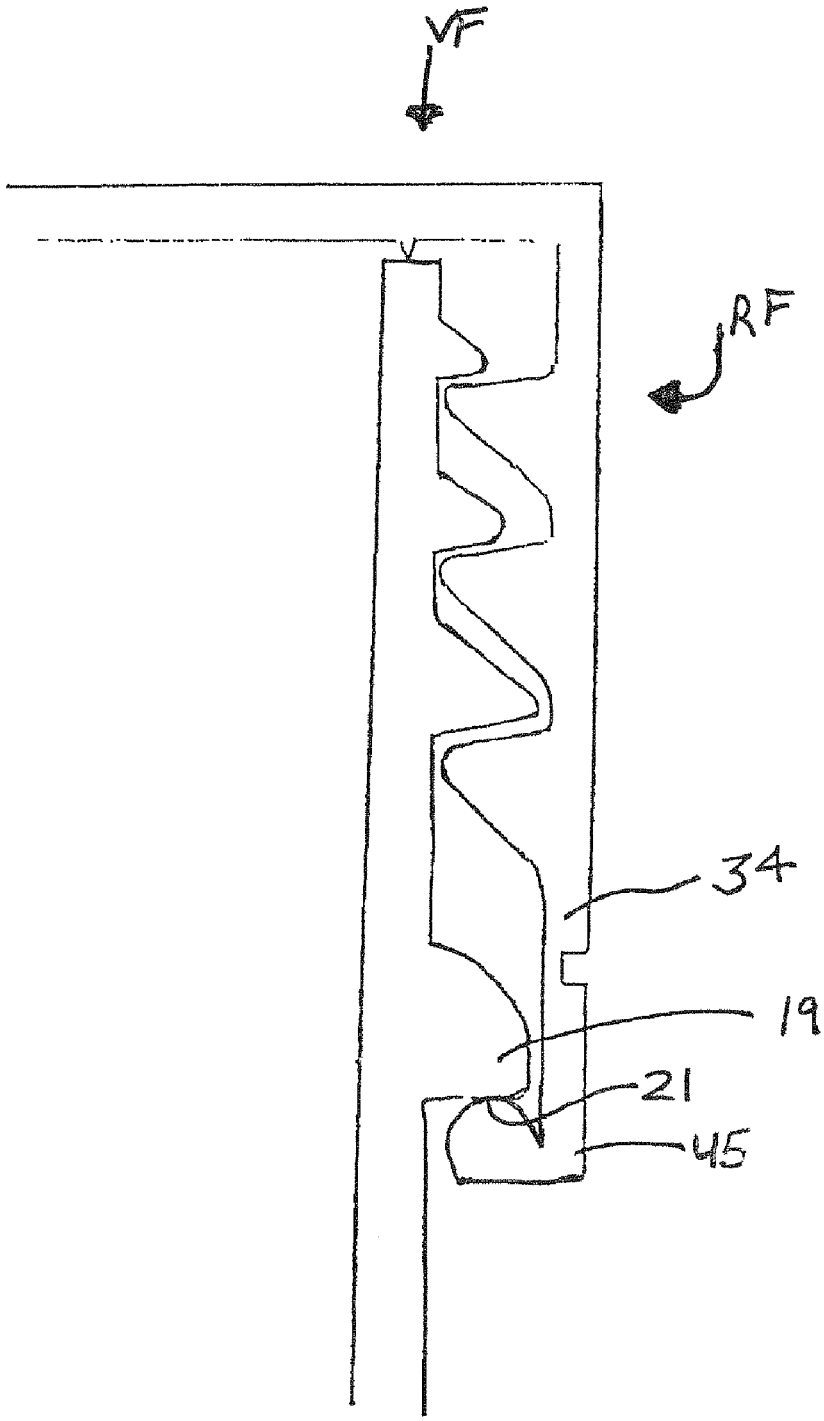
FIG. 8*a* is a side elevational view showing the combination of a closure having a bead-like engagement structure after complete application to the container finish of FIG. 5.

FIG. 8 illustrates the result achieved during a final application of the closure. In the final application station, vertical force per arrow VF is applied by a capping head (not shown) to move the "J Band" down the ramp to the bead 19 and simultaneously cause thread engagement between the closure and bottle finish. This is all done with the closure in the proper axial alignment conducive to proper thread engagement and prevent cross threading. The closure is twisted per rotational force arrow RF to impart relative rotation between the closure and the bottle finish to complete the complimentary thread engagement. The relative vertical movement associated with this increased threading causes the flange 48 to expand over retention bead 19 to allow free edge 49 to come to its final position in abutment with the lower surface 21 of retention bead 19. As is understood in the art, this abutment of the free edge 49 with the lower surface 21 resists upward movement of tamper band 42, thereby causing separation of the band from the upper closure skirt 34 when the closure is initially removed. It is understood that the twisting action associated with the final application shown in FIG. 8 may take other forms depending on the closure system. For example, with snap-on closures or "snap-on/twist off closures, the final application may consist of a simple axial movement accomplished with straight vertical force.

Figure 9:
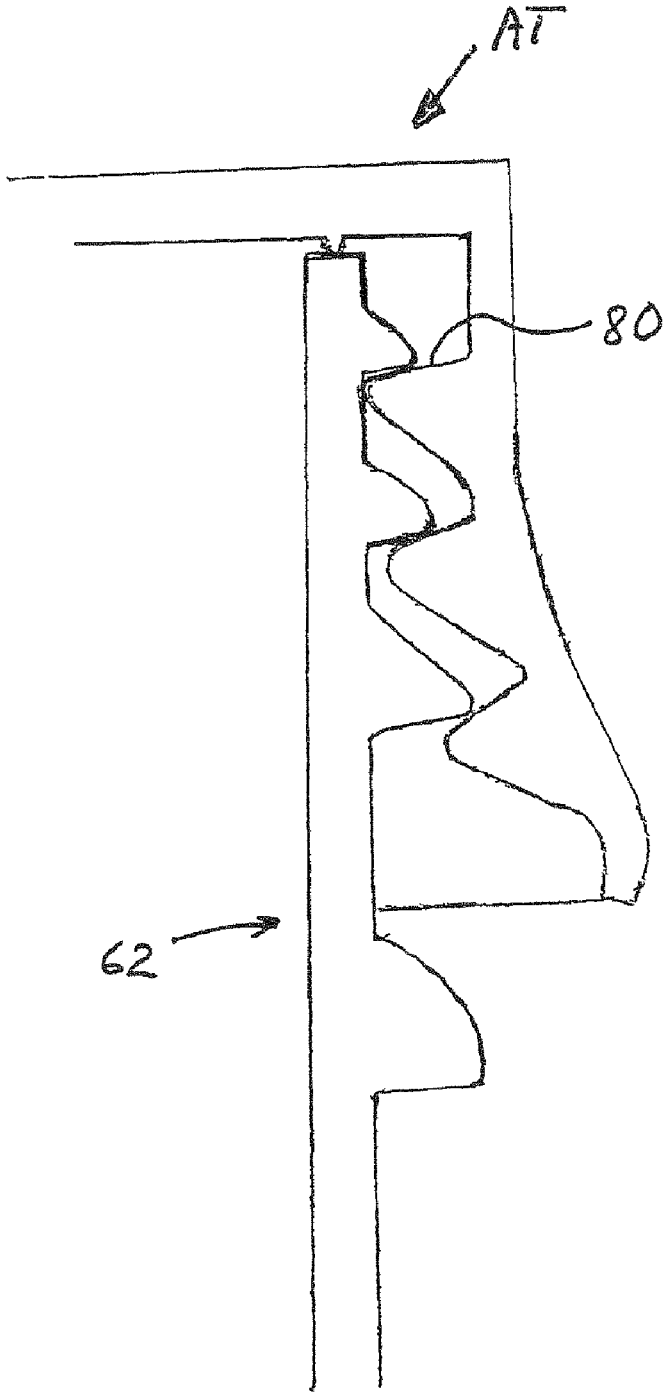
FIG. 9 is a side elevational view embodying the structural distortions occurring when a closure thread "strips" as a result of its inability to accommodate applied torque.

A further aspect of one or more of the embodiments is an increase in the ability of threaded closures to resist stripping under the action of applied torque. This feature is illustrated in conjunction with the situational embodiment of FIG. 9. FIG. 9 shows a condition which can develop when a closure is subjected to substantial application torque, either during initial application or reapplication. As is known, the upper surface 80 of a closure thread is often sloped upwardly/outwardly as is shown in the closure embodiments of this specification. This slope causes a component of the forces associated with the applied torque depicted by arrow AT to be directed radially outward, tending to expand the closure skirt. In general, the portion of the cap skirt least resistant to expansion is the vicinity of the lower thread start of the closure. Here, a number of structural factors result in minimizing the hoop strength of the closure. Thus, under excessive application torque, the hoop strength at the lower thread start is unable to adequately resist the expansion forces generated by the torque. The closure skirt expands as shown in FIG. 9, the expansion as shown is concentrated at the lower thread start. Eventually, thread engagement is lost at the lower thread start and the thread continues to lose engagement in a "tiring" mode upward along the helical path of the thread. Alternatively, for example in the case of a thin PE bottle such as 5 gallon and 1 gallon used in the dairy industry, the thin bottle thread finish distorts or deforms in a similar fashion.

Classical methods of plastic closure manufacture included unscrewing threads from the mold and use of relatively rigid materials such as polypropylene. In these classic cases the closure could be made very resistant to stripping. However, if one wishes to manufacture closures using a simpler molding process wherein threads are simply stripped from the mold, thread design and material selection must be considered. These considerations, in general, reduce the ability of the closure to resist stripping when applied to a container.

The novel container finishes of one or more of the embodiments can be adopted to recover some of the ability of certain closure systems to resist stripping. This is a result of the variable effective "T" dimension of the novel finishes taught here. These finishes incorporate a reduced effective "T" dimension in the upper portions of the container finish while expanding the effective "T" dimension as the thread descends vertically to its lower thread start (see FIG. 5). A fully applied closure having essentially constant thread root diameter will thus have reduced thread overlap with the container finish thread in the upper regions of thread overlap. This will result in decreased interference or increased clearance in these upper regions. However, from a stripping perspective, thread overlap in these upper regions is less critical, as suggested by the view of FIG. 9. In the lower regions of the container finish thread, the effective "T" dimension increases. Here, thread overlap is increased and specifically in the region sensitive to initiation of stripping, as explained above in the discussion of FIG. 9. Indeed, thread dimensions can be specified to give selective thread interference for some length of thread in this sensitive area. This interference can be specified to extend only through a chosen portion of the thread's helical path thereby ensuring that the closure is not difficult to manipulate in the hands of the consumer. The interference at the lower region of the thread permits facile release of the thread by the consumer, since the interference is relieved with just a short turn of the closure. In addition, the interference can act as a brake to resist closure back-off in those instances of multi-lead, high angled thread design.

When using low density polyethylene closures, typically about 0.020 inch diameter interference at the lower thread start, changing to 0.007 inch clearance at the upper thread start has given positive results. These dimensions are only typical and could vary considerably depending on structural design and material selection.

It is noted here that a classic "rule-of-thumb" for closure design is to ensure there be at least 0.001 inch of clearance between the finish "T" diameter and the closure thread root diameter in all cases. The current specification teaches a novel consideration of purposely designing in selective thread interference in those contact regions sensitive to closure stripping. Such selective interference may give particular advantage to systems employing thin walled closures or closures fabricated from relatively flexible materials such as low density polyethylene.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

We claim:

1. A neck finish for a container, the neck finish comprising:

a substantially cylindrical exterior wall surface surrounding an orifice defined in the container, the cylindrical exterior wall surface having a substantially constant effective exterior wall diameter;

a thread structure positioned about a section of the exterior wall surface, said thread structure having at least one single thread extending entirely around the exterior wall surface, the at least one single thread having at least a first portion, a second portion, positioned substantially axially below the first portion, and a third portion positioned substantially axially below the second portion, the first, second, and third portions, being inclined with respect to the other portions to provide a screw on neck finish, the first, second, and third portions further having a corresponding effective maximum diameter, and wherein the effective maximum diameter of said first portion is less than the effective maximum diameter of said second portion defining a first to second separation distance and the effective maximum diameter of said second portion is less than the effective maximum diameter of said third portion defining a second to third separation distance, whereby the effective maximum diameter of the thread structure changes throughout the section of the exterior wall surface.

2. The neck finish of claim 1, wherein the thread structure has a convex surface projecting radially outwardly from said exterior surface.

3. The neck finish of claim 1, wherein said first, second and third portions separately have defined points of maximum separation from said exterior surface.

4. The neck finish of claim 1, wherein the thread structure has an effective maximum diameter that continuously increases from said first portion to said second portion and from said second portion to said third portion.

5. The neck finish of claim 1, wherein the thread structure has an effective maximum diameter that incrementally increases from said first portion to said second portion and from said second portion to said third portion, such that the first to second separation distance and the second to third separation distance are substantially the same.

6. The neck finish of claim 1, wherein the thread structure has an effective maximum diameter that selectively increases from said first portion to said second portion and from said second portion to said third portion, such that the first to second separation distance is less than the second to third separation distance.

7. The neck finish of claim 1, wherein the thread structure is a single lead helical thread.

8. In combination, a neck finish for a container and a container closure, said neck finish having an upper orifice defining an opening, a downward extending neck wall below said opening, said neck wall having an exterior with a substantially constant effective exterior wall diameter and with a thread structure inclined about said exterior and a first bead structure surrounding said neck wall positioned axially below said inclined thread structure, said inclined thread structure having at least one single thread extending entirely around the exterior wall surface, such that the at least one single thread, having a first portion and a second portion positioned axially below said first portion, and a third portion positioned substantially axially below the second portion, the first, second, and third portions having a corresponding effective maximum diameter such that said effective maximum diameter of said first portion is less than the effective maximum diameter of said second portion defining a first to second separation distance and the effective maximum diameter of said second portion is less than the effective maximum diameter of said third portion defining a second to third separation distance, whereby the effective maximum diameter of the inclined thread structure changes throughout the section of the exterior wall surface such that the first to second separation distance and the second to third separation distance are substantially the same or such that the first to second separation distance is less than the second to third separation distance; and said container closure having a top, a downwardly extending skirt portion depending from said top, said skirt portion having an interior with a substantially constant effective interior wall diameter and a radially inwardly projecting member positioned within the interior of the skirt portion adapted for engagement with said first bead structure.

9. The combination of claim 8, wherein said radially inwardly projecting member comprises a second bead structure positioned within said interior of said skirt portion adapted for engagement with said first bead structure.

10. The combination of claim 8, wherein said radially inwardly projecting member comprises a "J-Band" structure positioned within said interior of said skirt portion adapted for engagement with said first bead structure.

11. The combination of claim 8, further including a clearance space when said container closure is initially applied to said container neck for closing, said clearance space disposed between an upper edge of the exterior of said neck wall and a free edge of the interior of said skirt portion.

12. The combination of claim 11, wherein said clearance space provides decreased interference or increased clearance with said first portion.

13. The combination of claim 11, wherein said clearance space provides resistance to stripping under the action of torque applied to said container closure.

14. The combination of claim 8, wherein said radially inwardly projecting member includes a tamper-evidencing band frangibly connected to said downwardly extending skirt portion and having an inwardly and upwardly turned retaining rim adapted for engagement with said first bead structure.

* * * * *